United States Patent [19]

Nickerson et al.

[11] 4,051,769

[45] Oct. 4, 1977

[54] SOLAR POWERED METHOD AND APPARATUS FOR VENTING GASEOUS MATERIAL FROM AN ENCLOSED SPACE TO ATMOSPHERE

[75] Inventors: Malcolm H. Nickerson, Chagrin Falls; William R. Rinker, Cuyahoga Falls, both of Ohio

[73] Assignee: The B. F. Goodrich Company, Akron, Ohio

[21] Appl. No.: 608,183

[22] Filed: Aug. 27, 1975

[51] Int. Cl.[2] ..... F24F 7/02

[52] U.S. Cl. ..... 98/43 R; 60/641; 417/207

[58] Field of Search ..... 236/49; 98/43, 42, 122; 417/207; 60/641; 237/1 A

[56] References Cited

U.S. PATENT DOCUMENTS

| | | | |
|---|---|---|---|
| 3,087,438 | 4/1963 | Ciesielski | 417/207 |
| 3,832,992 | 9/1974 | Trombe et al. | 237/1 A |

*Primary Examiner*—William E. Wayner

[57] ABSTRACT

Apparatus and method for venting moisture from the interior of an enclosed space to atmosphere while restricting the flow of ambient moisture back into the enclosed space. A chamber is provided in fluid communication with the substantially enclosed space. Means are provided for absorbing solar energy for heating the interior of the chamber when the chamber is exposed to sunlight. A first pressure sensitive valve is effective to vent moisture, liquid or other fluids from the chamber to atmosphere and to block flow between the chamber and the substantially enclosed space during the periods when the chamber is exposed to sunlight. A second pressure sensitive valve blocks flow of ambient air into the chamber and vents moisture or other gaseous material from the substantially enclosed space to the chamber during periods when the chamber is not exposed to sunlight. The method, according to the present invention, comprises the steps of venting moisture from an enclosed space into a chamber during periods where the chamber is not exposed to sunlight, sealing against backflow of gaseous material from the chamber to the enclosed space and venting the chamber to the atmosphere during periods of heating of the chamber by the sunlight to thereby vent fluid material from the enclosed space to the atmosphere.

8 Claims, 3 Drawing Figures

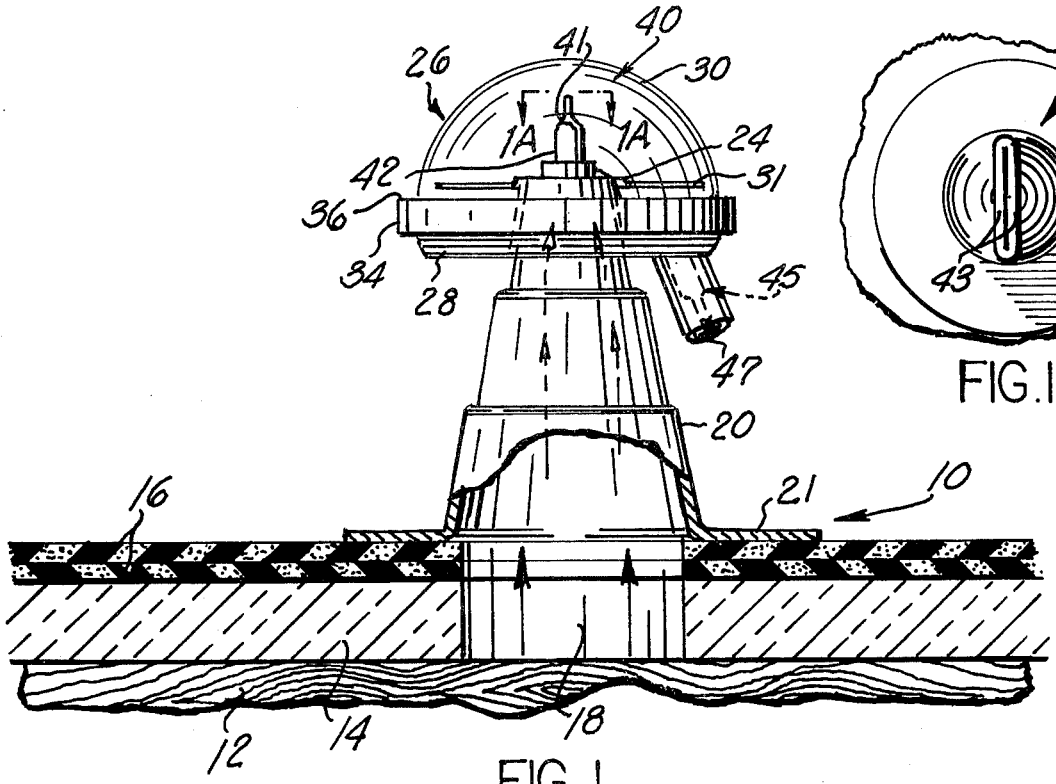
FIG. 1
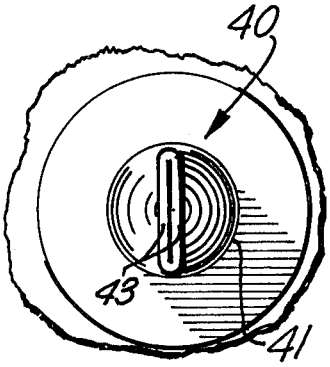
FIG. 1A
FIG. 2
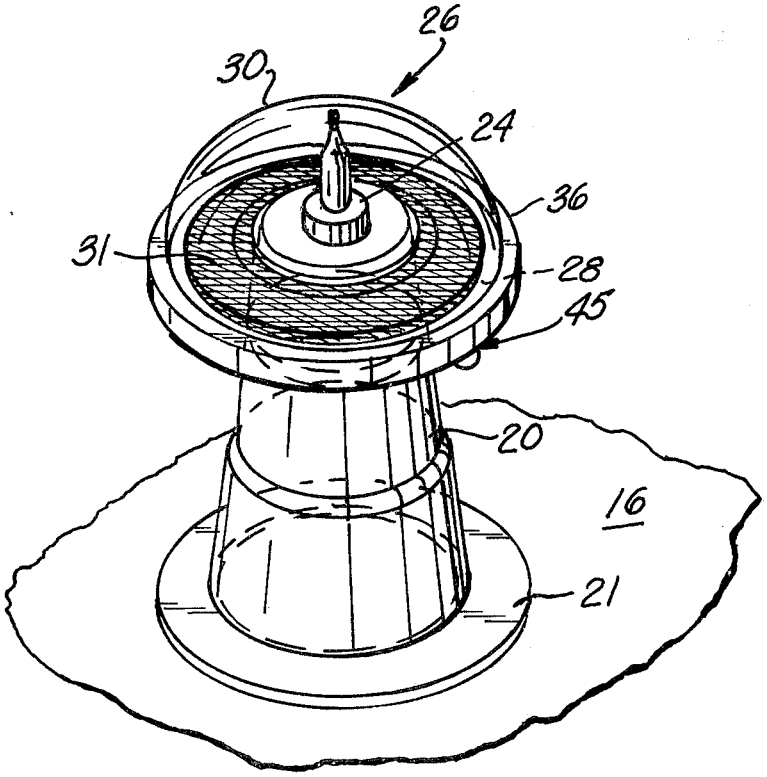

SOLAR POWERED METHOD AND APPARATUS FOR VENTING GASEOUS MATERIAL FROM AN ENCLOSED SPACE TO ATMOSPHERE

BACKGROUND OF THE INVENTION

This application relates generally to apparatus and method for venting fluid material from an enclosed space to atmosphere, and particularly to apparatus and method which are driven by solar energy for venting the enclosed space. The present invention has a particular utility for venting moisture from the interior of a built-up roofing system to the atmosphere.

In built-up roofing systems, in grain storage systems, and in numerous forms of existing housing-type structures which operate in moderately humid climates, moisture tends to be retained in substantially enclosed spaces within the housing. In a built-up roofing system, moisture can get into the interior of the system through the use of damp construction materials, through leaks in the roofing membrane or by migration of moisture from within the building. In air-conditioned buildings, conventional open-type vents often permit moisture to enter the system from the outside. Such moisture collects within the roofing system and is basically retained therewithin in a substantially enclosed condition by the normal roof membranes and insulation. Prior art structure for venting such moisture has consisted of open stacks extending from the interior of the roof system with the upper ends opening to atmosphere, and by apparatus such as shown in U.S. Pat. 2,600,947, 2,833,229 and 3,783,767.

Other forms of known solar powered devices are shown in U.S. Pat. Nos. 2,688,922, 2,601,905, 2,931,578, 3,436,908, 3,290,230, 3,168,450, 3,015,613, 2,820,744, 2,138,689 and 2,566,327.

SUMMARY OF THE PRESENT INVENTION

The present invention provides an apparatus and method for venting moisture from the interior of an enclosed space to atmosphere in a manner which effects efficient venting of the enclosed space while restricting the flow of ambient moisture back into the enclosed space.

The present invention further provides for the venting of moisture or other fluid from an enclosed space to atmosphere by means of structure which is simple, which has few moving parts, which is highly durable, and which is powered exclusively by solar energy. The present invention takes advantage of both periods of sunlight and periods of darkness or cloud coverings to automatically adjust itself to these conditions to vent moisture from the enclosed space to the atmosphere without permitting a return of ambient moisture into the enclosed space.

The preferred embodiment of the present invention provides a fluid passage having an intake portion which is in fluid communication with the interior of the enclosed space, and an exhaust portion. A chamber is provided which surrounds the exhaust portion of the fluid passage. A first pressure sensitive valve is provided between the exhaust portion of the fluid passage and the interior of the chamber for providing passage of moisture into the chamber during a drop in pressure of the gaseous material within the chamber, and for preventing flow of fluid from the chamber back into the enclosed space upon increase in pressure of the gaseous material within the chamber. A second pressure sensitive valve is provided between the interior of the chamber and atmosphere and is adapted to exhaust fluid (both liquid and gaseous) from the chamber to atmosphere as the gaseous fluid pressure in the chamber is increased due to solar heating of the interior of the chamber. When the pressure in the chamber is decreased (during evening hours or extended cloud coverings) the second pressure sensitive valve operates to seal the interior of the chamber against a backflow of ambient moisture into the interior of the chamber.

There is provided a means for absorbing radiant solar energy for promoting the heating of the gaseous fluid material on the interior of the chamber, so that as the gaseous fluid expands the first pressure valve is adapted to close off the fluid passage against flow of fluid from the chamber into the enclosed space while the buildup of pressure within the chamber is adapted to open the second pressure sensitive valve to vent gaseous fluid and liquid from the interior of the chamber to atmosphere. Upon the cooling of the chamber (for example, due to intermittent cloud covering or during night time hours) the contraction of the fluid material allows the first pressure sensitive valve to open and thereby vent moisture from the enclosed space through the fluid passage and into the interior of the chamber. It is contemplated that mechanical means may be further provided for insuring the closing of the second pressure sensitive valve and thus providing against flow of ambient moisture into the interior of the chamber. The above-described combination of valve means performs a two-way check against backflow of ambient moisture into the enclosed space, since both the first and second pressure sensitive valves, in combination with the chamber, block backflow of ambient moisture.

At the same time, the goals of the present invention are achieved by structure requiring very few moving parts, and thereby being very durable in operation. In the preferred embodiment both pressure sensitive valves are in the form of membranes of thin, flexible, substantially gas impervious material.

The method, according to the present invention, comprises the steps of venting moisture from an enclosed area of a roof deck into a chamber during periods where the chamber is not exposed to sunlight, sealing against backflow of gaseous material from the chamber into the enclosed space and venting the chamber to the atmosphere during periods of heating of the chamber by the sunlight to thereby vent fluid material from the enclosed space to the atmosphere.

DESCRIPTION OF THE DRAWINGS

The further objects and advantages of this invention will become further apparent from the following specification and the accompanying drawings wherein:

FIG. 1 is a diagrammatic sectional view of a roofing system employing the present invention; and FIG. 1A is an enlarged view of the portion of FIG. 1A designated 1A—1A in FIG. 1.

FIG. 2 is a perspective view of a venting apparatus according to the present invention.

DETAILED DESCRIPTION OF THE PREFERRED EMBODIMENT

As set forth above, the present invention relates to a method and apparatus for venting moisture or other fluid material from an enclosed space to atmosphere, and has particular application to the venting of moisture from the interior of a built-up roofing system. There is illustrated hereinafter the manner in which the present invention is employed for venting the interior of a built-up roofing system. However, from the description which follows, the manner in which this invention may be applied to numerous other types of systems will become readily apparent to those of ordinary skill in the art.

Referring now to FIG. 1, there is shown at 10 a built-up roofing system which could be built for numerous conventional types of structures. For illustration purposes, the built-up roofing system comprises a roof deck 12, a layer of insulation material 14 covering the roof deck 12, and a plurality of layers of roofing felts 16 which normally overlie the insulation material 14. The built-up roofing system is intended to prevent moisture from passing into the interior of the structure. However, as noted above, there are numerous ways in which moisture does, in fact, tend to collect within the housing structure. The built-up roofing system then tends to prevent the escape of this moisture from within the structure. It is this trapped moisture which is substantially enclosed within the confines of the built-up roofing system which the present invention serves to vent to the atmosphere.

For providing access to the substantially enclosed moisture pockets which collect within the roofing system, there is provided a hole 18 extending through the roofing felts 16 and the insulation 14. Extending outwardly from the roofing felts 16 is a stem, or stack, 20. The base 21 of the stack 20 is sealed to the roofing felts 16 and a circular opening at the bottom of the stack surrounds the hole 18 in substantially airtight relationship. The combination of the hole 18 and the stack 20 form a fluid passage for moisture trapped within the system. The upper end of the stack 20 forms an exhaust portion 24 for the fluid passage.

Surrounding the exhaust portion 24 is a chamber 26, having a lower portion 28 and an upper dome-shaped portion 30. The portion 32 of the lower portion 28 is in substantially airtight sealing engagement with the upper portion of the stack 20. The respective peripheral flanges 34, 36 of the lower portion 28 and the transparent dome portion 30 are in substantially airtight sealing relation with each other.

In its preferred embodiment, the dome portion 30 is formed of a hard transparent plastic material to permit infrared radiation from the sun to easily pass therethrough. Within the chamber there is disposed a black body, preferably in the form of a thin gage blackened aluminum disc 31 which surrounds the exhaust portion 24. The black body is thermally insulated from the plastic members 28, 30. The black body serves to absorb radiant energy from the sun and to transfer the radiant energy by conduction to the fluid medium within the chamber.

A first pressure sensitive valve 40 is provided at the exhaust opening 24 of the fluid passage. In its preferred embodiment the first pressure sensitive valve 40 comprises a thin flexible membrane 42 which is formed of material which is substantially air impervious. The membrane 42 is formed in the shape of a tube 41 with a flattened upper end, the walls 43 of which tend to remain sealed until they are forced to an open position when fluid pressure within the tube exceeds the fluid pressure outside the walls. The membrane 42 is thus sensitive to the gaseous fluid pressure difference between the interior of the chamber and the fluid passage. Expanding gaseous fluid pressure within the chamber serves to urge the walls 43 to a closed condition to seal the exhaust opening 24 against passage of fluid material from the interior of the chamber into the fluid passage. Contraction of the gaseous fluid volume within the chamber, and the associated gaseous fluid pressure drop which results, allows the pressure of the gaseous fluid material in the fluid passage to urge the walls away from a flattened condition to thereby form a fluid conduit to vent gaseous fluid from the fluid passage 24 into the interior of the chamber. Some of the moisture vented to the chamber in this manner may condense of the inner surface of the chamber and accumulate in the bottom of the chamber.

There is further provided a second pressure sensitive valve 45 in the chamber. The second pressure sensitive valve 45 is formed in the lower chamber section 28 and is of substantially similar construction to the first pressure sensitive valve and comprises a thin flexible membrane of air impervious material which is provided in the lower chamber section 28. When expanding air pressure within the chamber exceeds a predetermined level, the flattened walls 47 of the valve 45 are urged to an open condition in which they form a fluid conduit and permit exhausting of gaseous fluid (and any water condensate which has accumulated in the bottom of the chamber) from the interior of the chamber into the atmosphere. When the interior of the chamber is cooled (due to either the cool of the evening, or due to cloud covering the sun) and the air pressure within the chamber reduced, the valve 45 closes to thereby prevent backflow of ambient moisture into the chamber. A spring biased ball check valve may be used instead of the thin flexible membrane to form the second pressure sensitive valve. The valve would be spring biased toward a position in which it closes an outlet port in member 28.

Operation of the method of the present invention is as follows: during the cool of evening hours, or when a cloud covers the sun, the interior of the chamber 26 cools and the gaseous fluid therein contracts. The suction effect of the contracting fluid, and the attendant reduction in gaseous fluid pressure, tends to want to draw ambient moisture into the chamber through the second pressure sensitive valve 45. However, the air pressure outside the valve, and the original flattened wall set of the membrane close the valve to prevent such backflow of atmosphere. At the same time the suction effect of the contracting air, and the resulting pressure drop of fluid pressure within the chamber permits the first pressure sensitive valve 40 to open and permit the gaseous fluid from the interior of the enclosed space to thereby exhaust into the interior of the chamber.

During periods when the chamber is exposed to the sun, the radiant energy from the sun heats and expands the gaseous fluid within the chamber, and the resulting absorption of radiant energy and conduction of this energy to the gaseous fluid by the black body also serves to heat and expand gaseous fluid within the chamber. Such expansion of the gaseous fluid, and the attendant increase in fluid pressure within the chamber closes the first pressure sensitive valve 40 and opens the second pressure sensitive valve 45. The closing of the first pressure sensitive valve 40 prevents material from the chamber from venting back into the fluid passage, whereas opening of the second pressure sensitive valve permits venting of the interior of the chamber to atmosphere.

Thus, according to the present invention, there has been disclosed a method and apparatus for efficiently, and yet simply, venting moisture or other gaseous fluid from the interior of an enclosed space to the atmosphere. With the foregoing disclosure in mind, many and varied obvious modifications of this invention will become readily apparent to those of ordinary skill in the art.

Therefore, what is claimed is:

1. Solar powered apparatus for venting gaseous fluid from a substantially enclosed space to the atmosphere comprising a fluid passage having an intake portion disposed to be placed in fluid communication with the enclosed space, said fluid passage having an exhaust portion, a chamber surrounding the exhaust portion of said fluid passage with the exhaust portion in fluid communication with the interior of the chamber, first pressure sensitive valve means between said exhaust portion and the interior of said chamber, said first pressure sensitive valve means being responsive to the fluid pressures in said fluid passage and in said chamber such that it permits flow of fluid from said fluid passage into said chamber when the fluid pressure in said fluid passage exceeds the fluid pressure in said chamber by a predetermined amount and blocks flow of fluid from said chamber into said fluid passage when the fluid pressure in said chamber exceeds the fluid pressure in said fluid passage by a predetermined amount, second pressure sensitive valve means between the interior of said chamber and the atmosphere, said second pressure sensitive valve means being responsive to the fluid pressure within said chamber and to ambient pressure such that said second pressure sensitive valve means is adapted to open to exhaust fluid material from said chamber to the atmosphere when the pressure within said chamber exceeds ambient pressure by a predetermined amount and said pressure sensitive valve is adapted to close and prevent flow of ambient air into said chamber when fluid pressure within said chamber falls below ambient pressure by a predetermined amount, means within said chamber for absorbing radiant solar energy for heating and expanding gaseous fluid material on the interior of said chamber, said first and second valve means being responsive to the expansion of gaseous fluid which occurs due to solar heating, and being further responsive to the contraction of gaseous fluid material which occurs during periods of cooling of the gaseous fluid material on the interior of said chamber.

2. Solar powered apparatus as set forth in claim 1 wherein said chamber is formed of substantially transparent material, and said means for absorbing radiant solar energy comprises a substantially black body within said chamber.

3. Solar powered apparatus as set forth in claim 2 wherein said first pressure sensitive valve means comprises a flexible, substantially gas impervious membrane adapted to move to a position in which it seals said exhaust portion when fluid pressure in said chamber exceeds the fluid pressure in said fluid passage by a predetermined amount and being adapted to move to a position in which it permits fluid communication between said exhaust portion and said chamber when fluid pressure in said fluid passage exceeds the fluid pressure in said chamber by a predetermined amount.

4. Solar powered apparatus as set forth in claim 3 wherein said chamber includes an outlet opening, said second pressure sensitive valve comprises a flexible, substantially gas impervious membrane adapted to move to a position in which it seals the outlet opening when fluid pressure in the chamber drops below ambient pressure and being adapted to open to permit fluid communication between said chamber and atmosphere when fluid pressure in the chamber exceeds ambient pressure by a predetermined amount.

5. Solar powered apparatus as set forth in claim 4 wherein there is provided an outlet opening in said chamber, said second pressure sensitive valve means comprising check valve means biased toward a first position in which it closes said outlet opening, said check valve means being responsive to a predetermined fluid pressure in said chamber to be held away from said first position.

6. Solar powered apparatus as set forth in claim 5 comprising spring means for biasing said check valve toward said first position.

7. A method of venting gaseous fluid from an enclosed space to atmosphere comprising the steps of providing a chamber having a first portion in fluid communication with the enclosed space and a second portion in fluid communication with atmosphere, heating the interior of the chamber by solar energy during periods of exposure of the chamber to sunlight, closing the first portion of the chamber against flow and venting gaseous and liquid fluid from the chamber through the second portion to atmosphere during the heating of the chamber by solar energy, sealing the second portion against backflow of ambient gas into the chamber and venting gaseous fluid material from the enclosed space into the chamber during periods when the chamber is not exposed to sunlight.

8. In combination, a structure having a fluid retaining portion which retains moisture or other gaseous fluid, solar powered apparatus for venting moisture or other gaseous fluid from said fluid portion to the atmosphere comprising a chamber in fluid communication with said fluid retaining portion, means for absorbing solar energy for heating the interior of said chamber when said chamber is exposed to sunlight, means for venting moisture, liquid or other fluids from said chamber to atmosphere during periods when said chamber is heated by solar energy, means for blocking fluid flow between said chamber and said fluid retaining portion during periods when said chamber is exposed to sunlight, means for blocking flow of ambient air into said chamber during periods when said chamber is not exposed to sunlight, and means for venting moisture or other gaseous material from said fluid retaining portion to said chamber during periods when said chamber is not exposed to sunlight.

* * * * *